US006029133A

United States Patent [19]

Wei

[11] Patent Number: 6,029,133

[45] **Date of Patent: *Feb. 22, 2000**

[54] PITCH SYNCHRONIZED SINUSOIDAL SYNTHESIZER

[75] Inventor: Ma Wei, Singapore, Singapore

[73] Assignee: Tritech Microelectronics, Ltd., Singapore, Singapore

[ * ] Notice: This patent issued on a continued prosecution application filed under 37 CFR 1.53(d), and is subject to the twenty year patent term provisions of 35 U.S.C. 154(a)(2).

[21] Appl. No.: 08/929,950

[22] Filed: Sep. 15, 1997

[51] Int. Cl.[7] ..... G10L 9/16

[52] U.S. Cl. ..... 704/265; 704/264

[58] Field of Search ..... 704/265, 205, 704/219, 208, 223, 230, 231, 268, 264, 211, 261, 200, 206, 207

[56] References Cited

U.S. PATENT DOCUMENTS

| | | | |
|---|---|---|---|
| 4,771,465 | 9/1988 | Bronson et al. | 704/207 |
| 4,797,926 | 1/1989 | Bonson et al. | 704/214 |
| 4,937,873 | 6/1990 | McAulay et al. | 381/51 |
| 5,179,626 | 1/1993 | Thomson | 395/2 |
| 5,774,837 | 6/1998 | Yeldener et al. | 704/208 |

OTHER PUBLICATIONS

McAulay et al, "Mid–Rate Coding Based on A Sinusoidal Representation of Speech" Proceedings IEEE International Conf. on Acoustics Speech & Signal Processing, ICASSP'85 p 945–948, 1985.

Qian et al, "A Variable Frame Pitch Estimator & Test Results" Proceedings IEEE International Conf. on Acoustics, Speech & Signal Processing ICASSP'96, p 228–231, 1996.

Ma Wei "Multiband Excitation Based Vocoders and Their Real–Time Implementation" Dissertation, Univ. of Surrey. Guildford, Surrey UK May 1994, p 145–150.

Yang et al "Pitch Synchronous Multi–Band (PSMB) Speech Coding" Proceedings IEEE International Conf. on Acoustics, Speech & Signal Processing, ICASSP'95 p 516–9, 1995.

Griffin et al. "Mulitband Excitation Vocoder" Transactions on Acoustics, Speech & Signal Processing, vol. 36, No. 8, Aug. 1988, p 1223–35.

Hardwick et al, "A 4.8Kbps MultiBand Excitation Speech Coder" Proceedings IEEE International Conf. on Acoustics Speech & Signal Processing, ICASSP'88 p 374–377, N.Y. 1988.

(List continued on next page.)

*Primary Examiner*—Richemond Dorvil

*Attorney, Agent, or Firm*—George O. Saile; Stephen B. Ackerman; Billy J. Knowles

[57] ABSTRACT

A pitch synchronous sinusoidal synthesizer for multi-band excitation vocoders will produce excitation signals necessary to artificially mimic speech from input data. The input data will contain the pitch frequencies for current and previous synthesizing frame samples, starting phase information for all harmonics within the current synthesizing frame sample, magnitudes for each of the harmonics present within the current synthesizing frame sample, the voiced/unvoiced decisions for each of the harmonics within the current frame sample, and an energy description for the harmonics of the current synthesizing frame sample. The pitch synchronous sinusoidal synthesizer will produce the synthetic speech with a minimum of the distortion caused by the sampling and regeneration of the speech excitation signals. The pitch synchronized sinusoidal synthesizer has a plurality of pitch interpolators. The pitch interpolators will calculate the pitch periods and frequencies, the pitch magnitudes of all harmonics present in the frame sample, and the ending phase for each pitch period. The results from the interpolator are transferred to a bank of sinusoidal resonators. The sinusoidal resonators will produce the sinusoidal waveforms that compose the speech excitation signal. The plurality of waveforms are transferred to a gain shaping function which will sum the sinusoidal waveforms and shape the resulting signal according to an input description of the signal energy.

17 Claims, 6 Drawing Sheets

OTHER PUBLICATIONS

Griffin et al. "A New Pitch Detection Algorithm" Digital Signal Processing '84 ElSevier Science Publishers, 1984, p 395–399.

Griffin et al, "A New Model–Based Speech Analysis/Synthesis System" Proceedings IEEE International Conf. on Acoustics, Speech & Signal Processing ICASSP '85, 1985 p 513–516.

McAulay et al, "Computationally Efficient SineWave Synthesis And It's Application to Sinusoidal Transform Coding" Proceedings IEEE International Conf on Acoustics, Speech and Signal Processing, ICASSP'88, p370–3, 1988.

PITCH SYNCHRONIZED SINUSOIDAL SYNTHESIZER

RELATED PATENT APPLICATIONS

U.S. patent application Ser. No. 08/878,515, Filing Date: Jun. 19, 1997, "An Apparatus and Method for Efficient Pitch Estimation", Assigned to the Same Assignee as the present invention.

BACKGROUND OF THE INVENTION

1. Field of the Invention

This invention relates generally to the synthesis of electrical signals that mimic those of the human voice and other acoustic signals and more particularly the devices and methods to smooth frame boundary effects created during the encoding of the speech and acoustic signals.

2. Description of Related Art

Relevant publications include:

1. Yang et al., "Pitch Synchronous Multi-Band (PSMB) Speech Coding," *Proceedings IEEE International Conference on Acoustics, Speech, and Signal Processing* ICASSP'95, pp. 516–519, 1995 (describes a pitch-period-based speech coder);
2. Daniel W. Griffin and Jae S. Lim, "Multiband Excitation Vocoder," *Transactions on Acoustics, Speech, and Signal Processing*, Vol. 36, No. 8, August 1988, pp. 1223–1235 (describes a multiband excitation model for speech where the model includes an excitation spectrum and spectral envelope);
3. John C. Hardwick and Jae S. Lim, "A 4.8 Kbps Multi-Band Excitation Speech Coder," *Proceedings IEEE International Conference on Acoustics, Speech, and Signal Processing* ICASSP'88, pp. 374–377, New York 1988, (describes a speech coder that uses redundancies to more efficiently quantize the speech parameters);
4. Daniel W. Griffin and Jae S. Lim, "A New Pitch Detection Algorithm," *Digital Signal Processing* '84, Elsevier Science Publishers, 1984, pp. 395–399, (describes an approach to pitch detection in which the pitch period and spectral envelope are estimated by minimizing a least squares error criterion between the synthetic spectrum and the original spectrum);
5. Daniel W. Griffin and Jae S. Lim, "A New Model-Based Speech Analysis/Synthesis System," *Proceedings IEEE International Conference on Acoustics, Speech, and Signal Processing* ICASSP'85, 1985, pp. 513–516 (describes the implementation of a model-based speech analysis/synthesis system where the short time spectrum of speech is modeled as an excitation spectrum and a spectral envelope);
6. Robert J. McAulay and Thomas F. Quatieri, "Mid-Rate Coding Based On A Sinusoidal Representation of Speech," *Proceedings IEEE International Conference on Acoustics, Speech, and Signal Processing* ICASSP'85, 1985, pp. 945–948 (describes a sinusoidal model to describe the speech waveform using the amplitudes, frequencies, and phases of the component sine waves);
7. Robert J. McAulay and Thomas F. Quatieri, "Computationally Efficient Sine Wave Synthesis And Its Application to Sinusoidal Transform Coding," *Proceedings IEEE International Conference on Acoustics, Speech, and Signal Processing* ICASSP'88, 1988, pp. 370–373, (describes a technique to synthesize speech using sinusoidal descriptions of the speech signal while relieving the computational complexity inherent in the technique);
8. Xiaoshu Qian and Randas Kumareson, "A variable Frame Pitch Estimator and Test Results," *Proceedings IEEE International Conference on Acoustics, Speech, and Signal Processing* ICASSP'96, 1996, pp. 228–231, (describes a new algorithm to identify voiced sections in a speech waveform and determine their pitch contours); and
9. Ma Wei, "Multiband Excitation Based Vocoders and Their Real-Time Implementation", Dissertation, University of Surrey, Guildford, Surrey, U.K. May 1994, pp. 145–150 (describes vocoder analysis and implementations).

Sinusoidal synthesizers are widely used in multiband-excitation vocoders (voice coder/decoder) and sinusoidal excitation vocoders and therefore well known in the art. The principal behind these types of coders is to use banks of sinusoidal signal generators to produce excitation signals for the voiced speech or music. In order to smooth the frame boundary effects, interpolation of the phases of each sinusoidal waveform has to be performed which is normally on a sample by sample basis. This leads to a large computational burden.

There are a number of methods for computing the sinusoidal functions for the signal generators within a digital signal processor (DSP). These ways are a power series expansion, a table look-up, a second order filter, and a coupled form oscillator. The power series expansion is an accurate method for generation of the sinusoidal functions if the order is large enough. A table look-up method is generally considered as a fast approximation method and can give satisfactory accuracy as long as the appropriate table size is chosen. Nevertheless, the table index computation which is based on phase computation, requires either a conversion of floating point numbers to integers or integer multiplication with long word lengths. By comparison the fastest way to generate the sinusoidal functions is the use of a second order filter sinusoidal oscillator. Although it improves the speed of the computation, it can not be used in a synthesizer, because it requires linear phase increments which will not exist in the speech frames.

One way to solve this problem is to use the coupled form oscillator. The extra computations of orthogonal samples will reduce any speed gains and it will have the same speed as that of the table look-up method for sinusoidal synthesizer applications.

U.S. Pat. No. 4,937,873 (McAulay et al.) discloses methods and apparatus for reducing discontinuities between frames of sinusoidal modeled acoustic wave forms, such as speech, which occurs when sampling at low frame rates. The mid-frame interpolation, disclosed, will increase the frame rate and maintain the best fit of phases. However, after mid-frame estimation, a following stage of generating each speech sample is needed for the overlap-add synthesis stage. The method is based on a sample by sample or FFT method in the frequency domain to do the speech sample generation. The frequency domain will not provide a sharpness of speech that will be provide by execution in the frequency domain.

U.S. Pat. No. 5,179,626 (Thomson) discloses a harmonic coding arrangement where the magnitude spectrum of the input speech is modeled at the analyzer by a small set of parameters as a continuos spectrum. The synthesizer then determines the spectrum from the parameters set and from the spectrum of the parameter set, the synthesizer determines the plurality of sinusoids. The plurality of sinusoids are then summed to form synthetic speech.

SUMMARY OF THE INVENTION

An object of this invention is to produce excitation signals necessary to artificially mimic speech from input data. The input data will contain the pitch frequencies for current and previous synthesizing frame samples, starting phase information for all harmonics within the current synthesizing frame sample, magnitudes for each of the harmonics present within the current synthesizing frame sample, the voiced/unvoiced decisions for each of the harmonics within the current frame sample, and an energy description for the harmonics of the current synthesizing frame sample.

Further an object of this invention is to produce the synthetic speech without any of the distortion caused by the sampling and regeneration of the speech excitation signals.

To accomplish these and other objects, a pitch synchronized sinusoidal synthesizer has a plurality of pitch interpolators. The pitch interpolators will calculate the interpolated pitch periods and frequencies, the pitch magnitudes of all harmonics present in the frame sample, and the ending phase for each pitch period. The results from the interpolator are transferred to a plurality of pitch resonators. The plurality of pitch resonators will produce the sinusoidal waveforms that are to compose the speech excitation signal. The plurality of waveforms are then transferred to a gain shaping function which will sum the sinusoidal waveforms and shape the resulting signal according to an input description of the signal energy.

DETAILED DESCRIPTION OF THE INVENTION

A pitch synchronized sinusoidal synthesizer will significantly reduce the computation complexity and memory size of sinusoidal excitation synthesizers, reducing by more than half the computational complexity than the fastest table look-up method, but with no table memory requirement. The synthesized speech/audio signal quality will remain the same or better for the speech signal as it mimics the real speech production mechanism.

The pitch synchronized sinusoidal synthesizers interpolates the pitch frequencies and random disturbing phases in the pitch period intervals. Therefore the harmonics can be efficiently synthesized using second order resonators within the pitch period.

Pitch interpolation can be done both in the time domain or in the frequency domain, with the performance for both types of determination calculations being similar.

Figure 1:
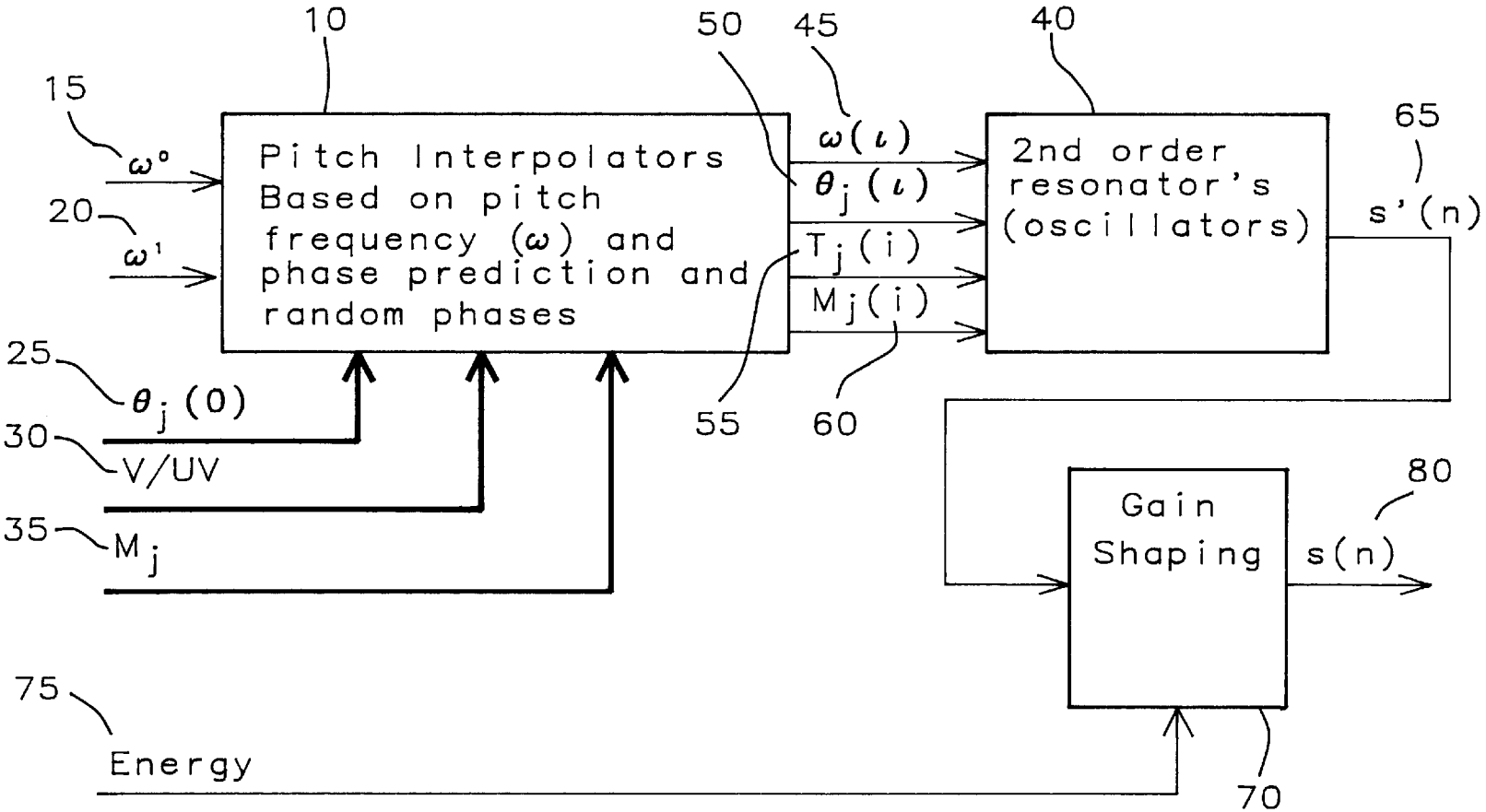
FIG. 1 is a schematic block diagram of a first embodiment of a pitch synchronized sinusoidal synthesizer of this invention.

Refer to FIG. 1 for an explanation of a first embodiment of a pitch synchronizing sinusoidal synthesizer. Multiple pitch interpolators 10 receive the data containing the pitch frequency $\omega^0$ 15 for the current synthesizing frame and the pitch frequency $\omega^1$ 20 for the previous synthesizing frame. The synthesizing frame will be the time period that the original speech is sampled to create the incoming data. The incoming data will also contain the ending phase information $\theta_j(\mathbf{0})$ 25 for all the harmonics (j) within the previous synthesizing frame. The incoming data will further contain the voiced/unvoiced decisions $V/UV_j$ 30 for each of the harmonics (j) within the current synthesizing frame. The voiced/unvoiced decisions are the indications that the speech sample within the synthesizing frame are either voiced sounds or unvoiced sounds. Next the incoming data will contain the magnitudes $M_j$ 35 of each of the harmonics within the synthesizing frame.

The interpolation of the pitch periods $\tau_p(i)$ between the previous synthesizing frame and the current synthesizing frame are determined by equation 1 of table 1. κ is equation 2 of table 1, $P^0$ is equation 3 of table 1, and $P^{-1}$ is equation 4 of table 1. L is the time period of the synthesizing frame.

The interpolated pitch frequency $\omega_j(i)$ 45 is determined by equation 5 of table 1, where j is the jth harmonic within the ith pitch period.

The interpolated magnitude $M_j(i)$ 60 is the magnitude for the jth harmonic during the ith pitch period and determined by equation 6 of table 1. $M_j^0$ is the jth harmonic for the current frame and $M_{j-1}$ is the jth harmonic for the previous frame.

The ending phase $\theta_j(i)$ 50 for the jth harmonic in the ith pitch period is determined by equation 7 of table 1. $\Phi_j(\mathbf{0})$ is the starting phase for the current frame which is equal to the ending phase for the previous frame. $\Phi_j(\mathbf{0})$ will be updated at the end of each frame by the equation 11 where I is the smallest integer such that:

$$I = \sum_{k=1}^{k=I-1} \tau_p(k) \geq L$$

and L is the length of the frame to be synthesized.

TABLE 1

(1)
$$\tau_p(i) = \frac{\tau_p(i-1)}{1-\kappa} \text{ for } i = 1, 2, \ldots, I$$
$$\tau_p(0) = P^{-1}$$

(2)
$$\kappa = \frac{(P^0 - P^{-1})}{L}$$

(3)
$$P^0 = \frac{2\pi}{\omega^0}$$

(4)
$$P^{-1} = \frac{2\pi}{\omega^{-1}}$$

(5)
$$\omega_j(i) = \frac{2j\pi}{\tau_p(i)}$$

(6)
$$M_j(i) = M_j(i-1) + \frac{M_j^0 - M_j^{-1}}{2L}\tau_p(i)$$
$$M_j(0) = M_j^{-1} \text{ for } i = 1, 2, \ldots, I$$

TABLE 1-continued

| | |
|---|---|
| (7) | $\theta_j(i) = \sum_{k=0}^{k=i} \omega_j(k)\tau_p(k) + \Phi_j(0)$ <br> $\theta_j(i) = \Phi_j(0)$ for $i = 1, 2, \ldots, I$ |
| (8) | $S(n) = G(n)S'(n)$ |
| (9) | $G(n) = G^{-1} + \frac{n(G^0 - G^{-1})}{L}$ |
| (10) | $G^0 = \frac{\sqrt{\sum_{n=0}^{n=L} [S'(n)]^2}}{\text{Energy}}$ |
| (11) | $\Phi_j = \theta_j(I-1) + \omega_j(I)\left[L \sum_{k=1}^{k=I-1} \tau_p(k)\right]$ |

The pitch frequencies $\omega_j(i)$ 45, the ending phase $\theta_j(i)$ 50, the time duration of each pitch period $\tau_p(i)$, and the magnitude $M_j(i)$ 60 for each harmonic (j) during each pitch period (I) are transferred to the bank of second order resonators. The second order resonators are configured as two-poled bandpass filters with a pair of conjugate poles located on the unit circle so that the filter will oscillate. The bank of second order resonators will generate all harmonics (j) during the pitch period (I).

Figure 2A:
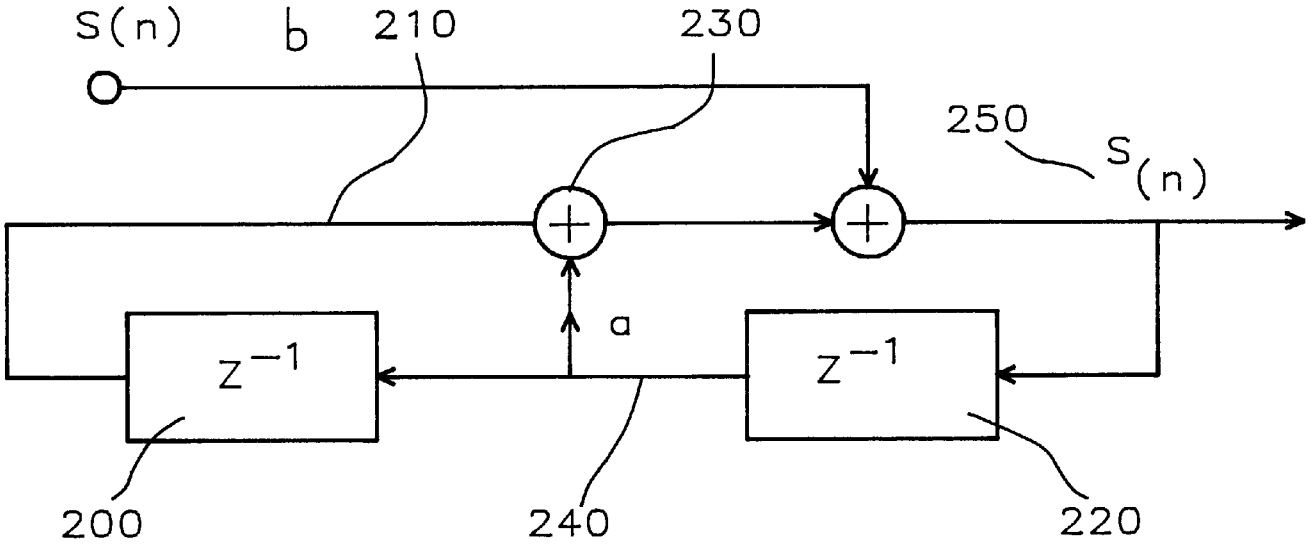
FIGS. 2*a* and 2*b* are schematic block diagrams of a second order resonator of this invention.
Figure 2B:
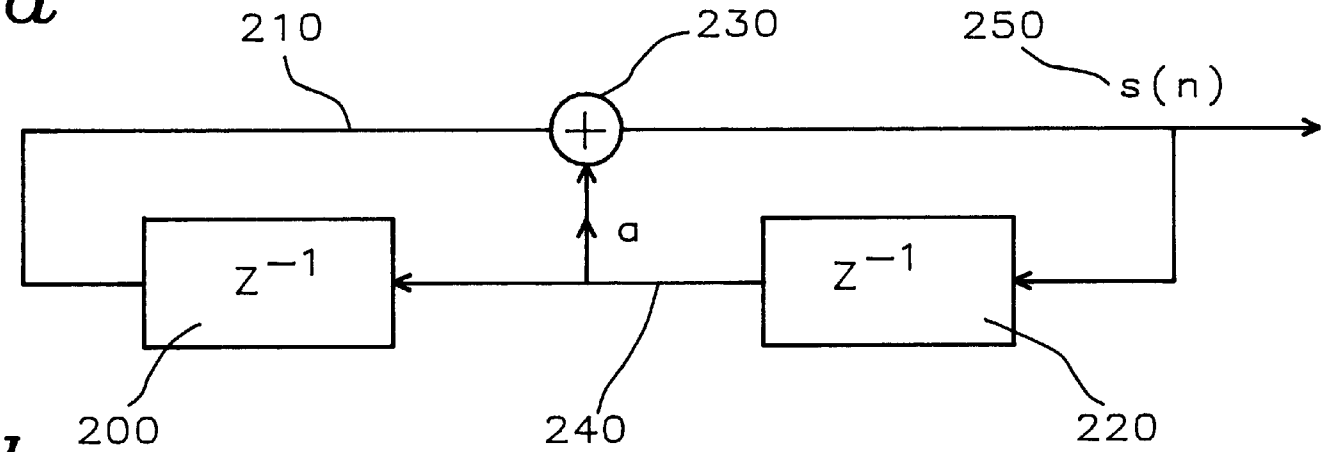

FIGS. 2*a* and 2*b* show block diagrams of the second order resonator. The output sample of the digital oscillator is s(n) at time index n. The output sample s(n) can be recursively generated on itself. So it is a kind of infinite impulse response (IIR) filter with poles on the unit circle. The system transfer function (in the Z domain) is:

$$H(z) = \frac{b}{1 - az^{-1} + z^{-2}}$$

where:

$b=M_j(i)\sin[\Theta(i-1)]$ $a=2M_j(i)\cos[\omega_j(i)]$ $s(-1)=s(-2)=0$

As the circuit described in FIG. 2*a* is a non stable filter, it will be self-sustaining as long as an impulse $\delta(n)$ is an initial input when n=0.

In the time domain the system can be described as:

$$s=as(n-1)-s(n-2)+b\delta(n)$$

The second order resonator can also be implemented as shown in FIG. 2*b* with no input signal, but with an initial non zero status.

$$s=as(n-1)-s(n-2)$$

where:

$a=2M_j(i)\cos[\omega_j(i)]$ $s(-1)=0$ $s(-2)=M_j(i)\sin[\Theta_j(i-1)]$

Returning to FIG. 1, the outputs S'(n) 65 of the second order resonators 40 are transferred to the gain shaping circuit 70. The output signal S(n) 80 is determined by equation 8 of table 1. The gain factor G(n) is determined by equation 9 of table 1, the current gain factor $G^0$ for the current synthesizing frame is determined by equation 10 of table 1, and the previous gain factor $G^{-1}$ is gain factor computed according the equation 10 of table 1 when the previous synthesizing frame was the current synthesizing frame. The Energy component is the Energy 75 information of the incoming data describing the energy content of the original speech.

Figure 3:
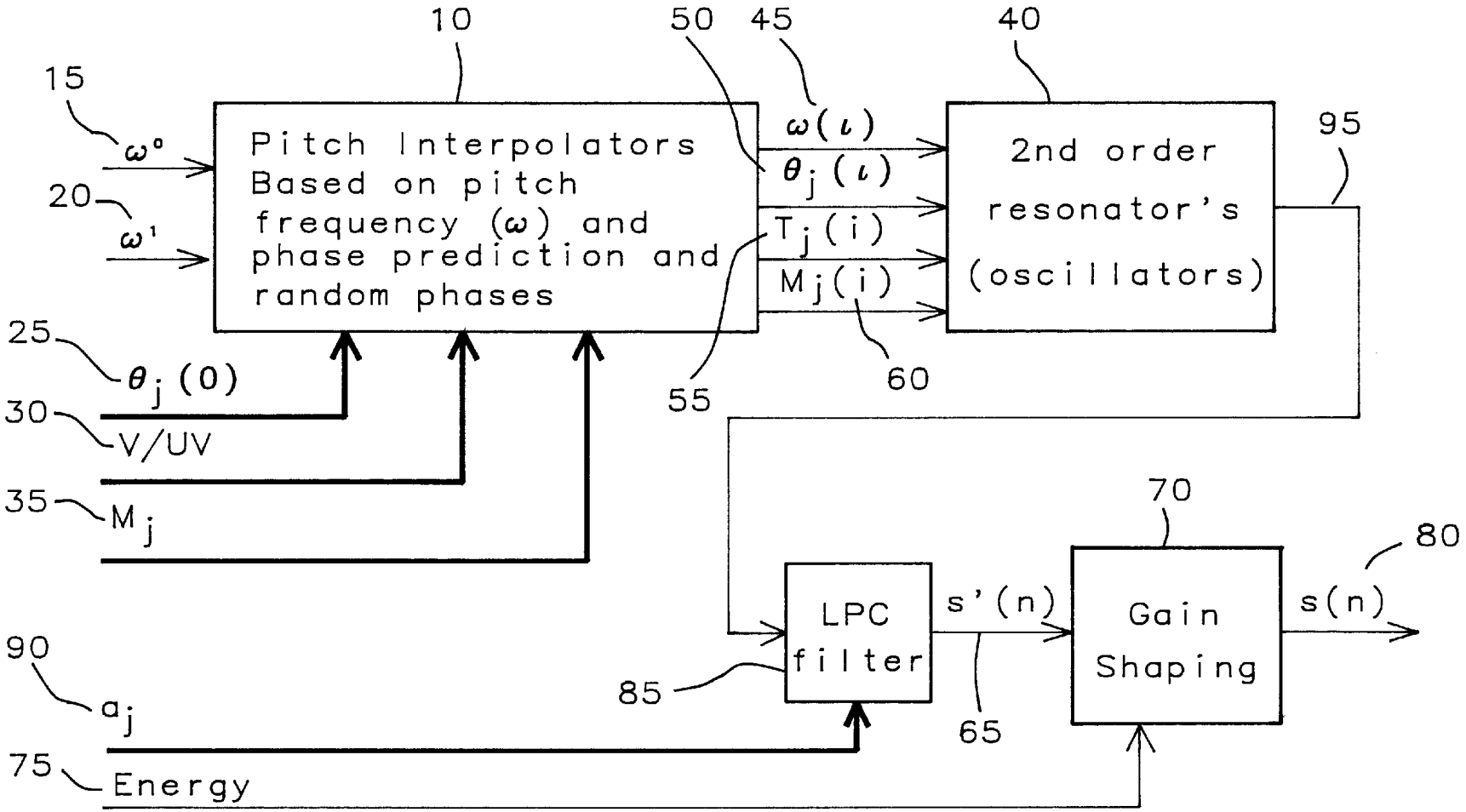
FIG. 3 is a schematic block diagram of a second embodiment of a pitch synchronized sinusoidal synthesizer of this invention.

Referring now to FIG. 3, the structure and function of the components of FIG. 3 are the same as above described in FIG. 1 except a linear predictive coding (LPC) filter 85 receives the output 95 of the second order resonator 40. The linear predictive filter 85 is an IIR filter which is used to synthesize the speech signals. In multi-band excitation and sinusoidal speech coders, this step is not needed since the speech spectrum envelope information is carried through the harmonic magnitudes $M_j$. But in LPC type vocoders, the envelope information is carried by the linear predictive coding coefficients. This will allow for further data compression. In the LPC method, magnitude $M_j$ is derived from the LPC parameters $a_i$ 90 to further enhance the speech quality. The method in this invention provides a means to efficiently generate the harmonics.

The LPC coefficients consists of a number (8–15) of filter coefficients for the following filters in the z domain:

$$H(z) = \frac{b_0}{1 - \sum_{i=1}^{N} a_i z^{-1}}$$

In the time domain the LPC filter 85 can be represented as a predictive filter in which the current speech sample can be predicted by a number of previous samples with a set of prediction coefficients $a_i$. The output S'(n) 65 of the linear predictive coder filter 85 is now the input of the gain shaping circuit 70 which will now form the output speech signal S(n) 80.

Figure 4:
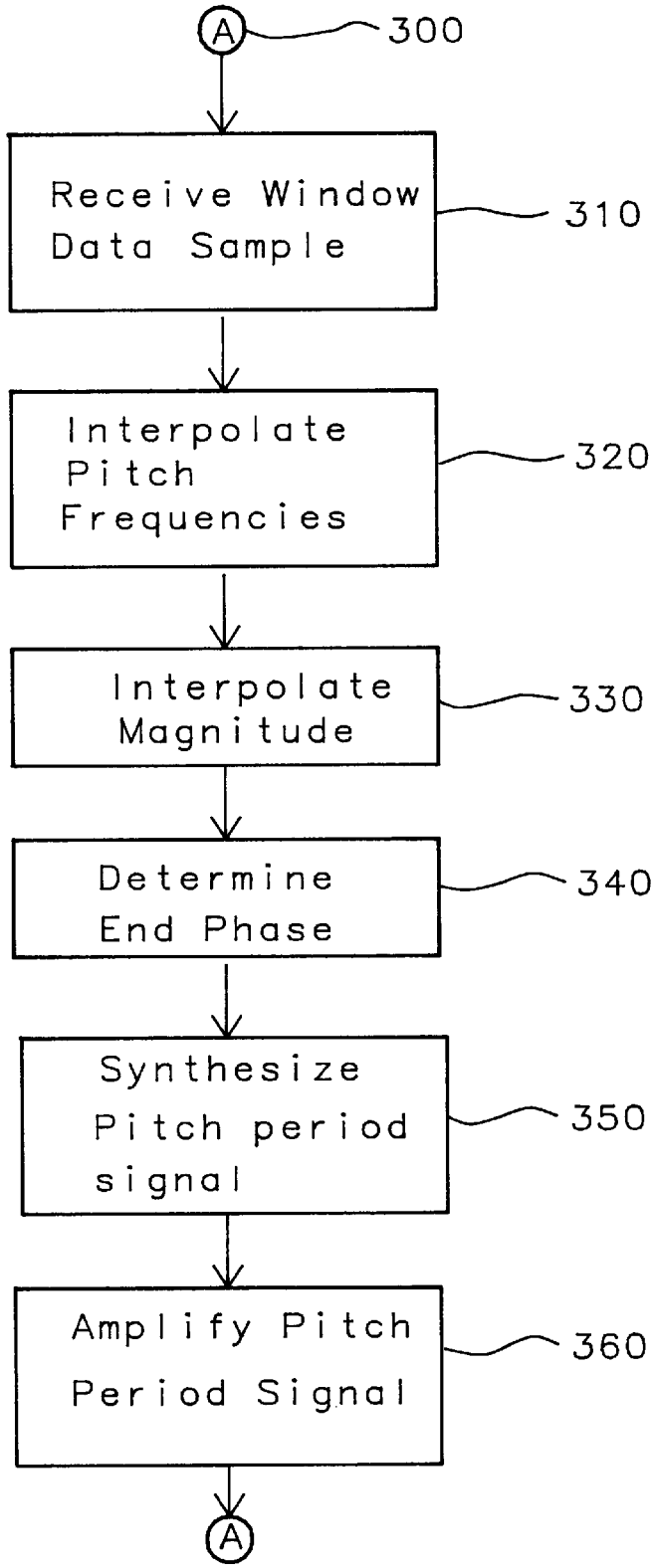
FIG. 4 is a flowchart of the method for pitch synchronous sinusoidal synthesizing of this invention.

A method for pitch synchronous synthesizing of speech signals is shown in FIG. 4. The process is started at point A 300 and the windowed data sample is received 310. The windowed data sample contains:

- the pitch frequency for the current synthesizing frame $\omega^0$;
- the pitch frequency for the previous synthesizing frame $\omega^{-1}$;
- the ending phase information $\theta_j(\mathbf{0})$ for all the harmonics (j) within the previous synthesizing frame;
- the voiced/unvoiced decisions $V/UV_j$ for each of the harmonics (j) within the current synthesizing frame; and
- the magnitudes $M_j$ of each of the harmonics within the synthesizing frame.

The pitch frequency $\overline{\omega}(i)$ for each pitch period i is then interpolated 320.

Figure 5:
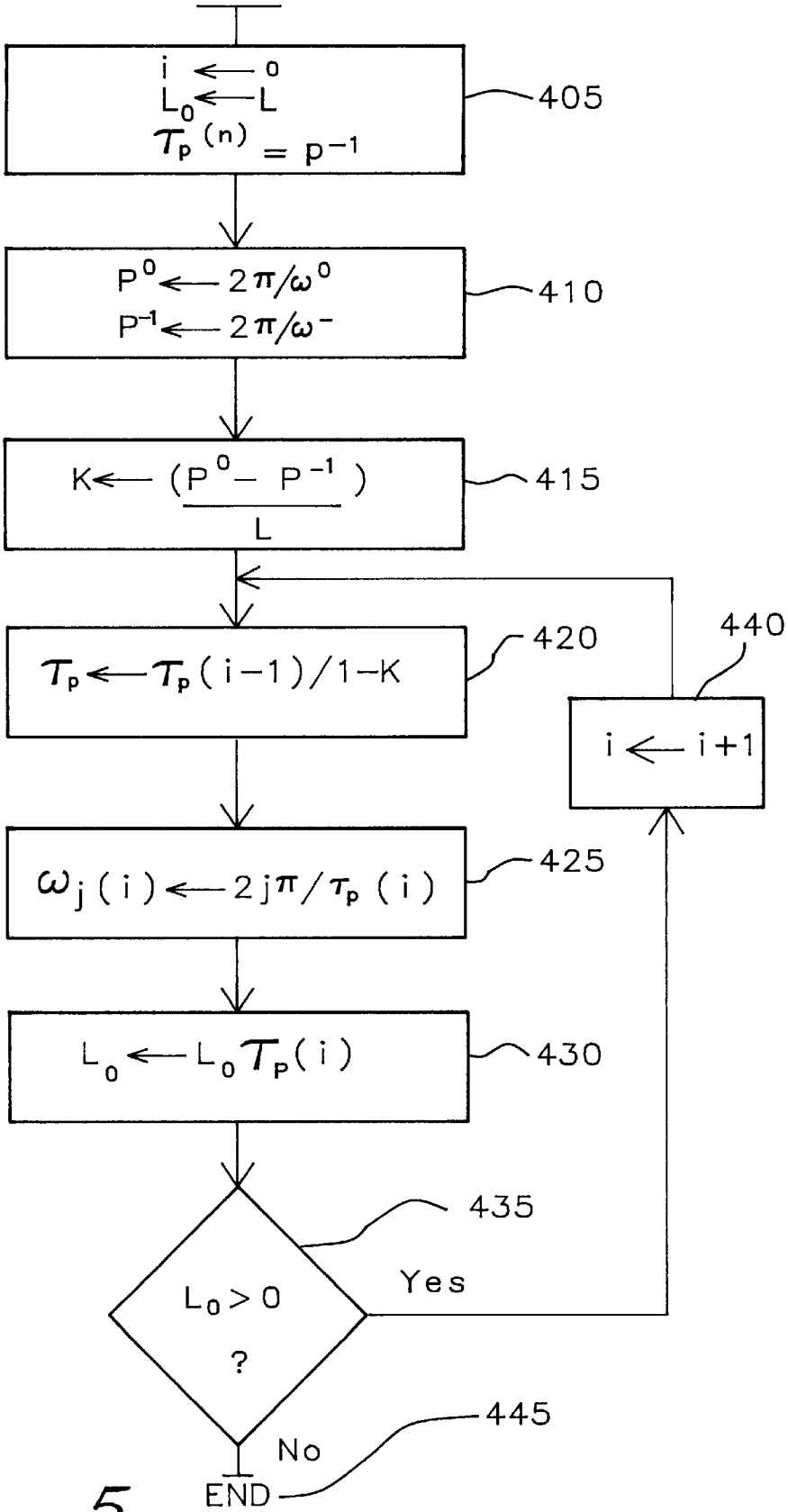
FIG. 5 is a flowchart of the method for the interpolating of pitch frequencies in the time domain of this invention.

FIG. 5 shows the interpolation process in the time domain. A counting variable i is initialized 405 to zero, and the frame length variable $L_0$ is assigned 405 the time period of the synthesizing frame L. The current and previous initial pitch periods $P^0$ and $P^{-1}$ are determined by equations 3 and 4 respectively of table 1. The period constant $\kappa$ is determined 415 by the equation 2 of table 1. The current interpolated pitch period is determined 420 by equation 1 of table 1. The previous interpolated pitch period $\tau_p(i-1)$ is the interpolated pitch period $\tau_p(i-1)$ calculated when the previous pitch period was the current pitch period.

The interpolated pitch frequency $\omega_j(i)$ for each of the harmonics (j) is determined 425 by equation 5 of table 1.

The length of the current pitch period $\tau_p(i)$ is subtracted 430 from the frame length variable $L_0$. If the frame length variable $L_0$ is determined 435 to be greater than zero, the counting variable is incremented 440 by 1 and the next interpolated pitch period $\tau_p(i)$ is determined 420. If all the interpolated pitch period have been determined 435, the process is ended 445.

Figure 6:
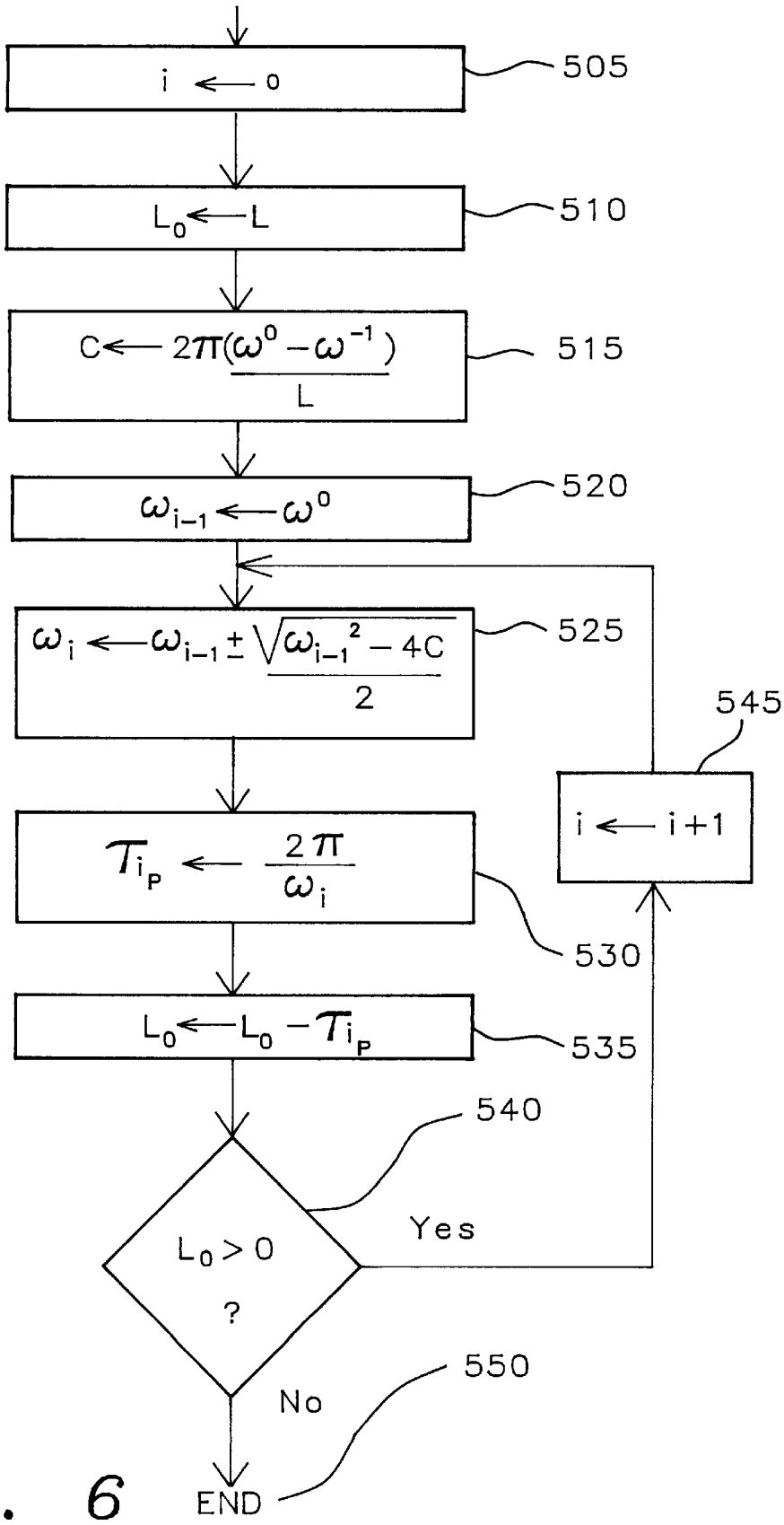
FIG. 6 is a flowchart of the method for the interpolating of pitch frequencies in the frequency domain of this invention.

An alternative process for the interpolations process using the frequency domain is shown in FIG. 6. The counting variable i is initialized 505 to one and the frame length variable $L_0$ is set 510 to the sampling frame length. A pitch frequency constant C is determined 515 by equation 1 of table 2. The initial interpolated pitch frequency $\omega(\mathbf{0})$ is assigned 520 the current pitch frequency $\omega^0$. The current interpolated pitch frequency $\omega(i)$ is determined 525 by equation 2 of table 2. There are two roots for the equation 2 of table 2. The root is selected by the following criteria:

$$\omega(i)>\omega(i-1) \text{ if } \omega^0>\omega^{-1}$$

$$\omega(i)<\omega(i-1) \text{ if } \omega^0<\omega^{-1}.$$

The interpolated pitch frequency $\tau_p(i)$ is calculated 530 by equation 3 of table 2.

TABLE 2

| | |
|---|---|
| (1) | $C = \frac{2\pi(\omega^0 - \omega^{-1})}{L}$ |
| (2) | $\omega(i) = \frac{\omega(i-1) \pm \sqrt{\omega(i-1)^2 - 4C}}{2}$ |
| (3) | $\tau_p(i) = \frac{2\pi}{\omega(i)}$ |
| (4) | $\kappa = \frac{C}{\omega^0 - \omega^{-1}}$ |

The interpolated pitch period $\tau_p(i)$ is subtracted 530 from the frame length variable $L_0$. If the result of the subtraction 540 is greater than zero, the counting variable i is incremented 545 and the next interpolated pitch frequency $\overline{\omega}(i)$ is calculated 525. If the frame length variable is determined 540 to be not greater than zero the process is ended 550.

Returning to FIG. 4 each magnitude $M_j(i)$ for each harmonic (j) of each pitch period (i) is interpolated 330 by equation 6 of table 1. If the interpolated pitch frequency is determined in the time domain by the method of FIG. 6, then $\kappa$ is determined by equation 4 of table 2. The next ending phase $\theta_j(i)$ of each harmonic (j) of each pitch period (i) is determined 340 by the equation 7 of table 1. The signal S'(n) containing the plurality of sinusoid waveforms for each pitch period (i) is then synthesized 350 in a second order resonator as described above. The signal S'(n) is then merged and amplified 360. The gain factor for the merging and amplification 360 are determined by the equation 8 of table 1. The gain factor G(n) is determined by equation 9 of table 1, the current gain factor $G^0$ for the current synthesizing frame is determined by equation 10 of table 1, and the previous gain factor $G^{-1}$ is gain factor computed according the equation 10 of table 1 when the previous synthesizing frame was the current synthesizing frame. The Energy component is the Energy 75 information of the incoming data describing the energy content of the original speech.

The process as described above is then iterated for each synthesizing frame.

While this invention has been particularly shown and described with reference to the preferred embodiments thereof, it will be understood by those skilled in the art that various changes in form and details may be made without departing from the spirit and scope of the invention.

What is claimed is:

1. A pitch synchronized sinusoidal synthesizer to produce excitation signals to artificially mimic human speech or acoustic signals from data, wherein said data comprises pitch frequencies of said human speech or acoustic signals for current and previous synthesizing frame samples, starting phase information for all harmonics of said human speech or acoustic signals within said current synthesizing frame sample, magnitudes for said harmonics, the voiced/unvoiced decisions for said harmonics, and an energy description of said synthesizing frame sample, comprising:

a) a plurality of pitch interpolation means, wherein each pitch interpolation means receives said data and calculates a plurality of pitch period intervals of said human speech or acoustic signals within said synthesizing frame sample, an interpolated pitch frequency for each harmonic of said human speech or acoustic signals within said pitch period within each current synthesizing frame sample, an ending phase for each pitch period for said harmonics, a time period for each pitch period, and an interpolated magnitude of each harmonic during each pitch period;

b) a plurality of resonator means coupled to said plurality of pitch interpolation means to produce a plurality of sinusoidal waveforms having the pitch frequency harmonics, time period and magnitude calculated by said pitch interpolation means for said human speech or acoustic signals; and c) a gain shaping means coupled to said plurality of resonator means to merge and amplify said plurality of sinusoidal waveforms according to said energy description, to produce said excitation signals for said human speech or acoustic signals.

2. The synthesizer of claim 1 wherein each pitch period of the plurality of pitch periods of said human speech or acoustic signals is determined by the following equation:

$$\tau_p(i) = \frac{\tau_p(i-1)}{1-\kappa}$$

where:

i is the number of the pitch period interval, $\tau_p(i)$ is the pitch period interval of the current pitch period i, $\tau_p(i-1)$ is the pitch period interval for the previous pitch period, $\kappa$ is determined as $$\kappa = \frac{(P^0 - P^{-1})}{L}$$

where $$P^0 = \frac{2\pi}{\omega^0}$$

$$P^{-1} = \frac{2\pi}{\omega^{-1}}$$

where $\omega^0$ is the current pitch frequency $\omega^{-1}$ is the previous pitch frequency and L is a period of time of the synthesizing frame sample.

3. The synthesizer of claim 2 wherein said interpolated pitch frequency of said human speech or acoustic signals is determined by the following equation:

$$\omega_j(i) = \frac{2j\pi}{\tau_p(i)}$$

where j is a first counting variable representing each of the harmonics, and $\overline{\omega}_j(i)$ is the frequency of each harmonic within the pitch period.

4. The synthesizer of claim 3 wherein said interpolated magnitude is determined by the following equation:

$$M_j(i) = M_j(i-1) + \frac{M_j^0 - M_j^{-1}}{2L}\tau_p(i)$$

$$M_j(0) = M_j^{-1}$$

$$\text{for } i = 1, 2, \ldots, I$$

where $M_j(i)$ is the magnitude of the harmonics within the current pitch period, and $M_j(i-1)$ is the magnitude of the harmonics within the previous pitch period.

5. The synthesizer of claim 4 wherein said ending phase is determined by the following equation:

$$\theta_j(i) = \sum_{k=0}^{k=1} \omega_j(k)\tau_p(k) + \Phi_j(0)$$

$$\theta_j(i) = \Phi_j(0)$$

$$\text{for } i = 1, 2, \ldots, I$$

where $\theta_j(i)$ is the ending phase, $\Phi_j(i)$ is and initial ending phase, and k is a second counting variable for the number of all the pitch intervals.

6. The synthesizer of claim 1 wherein each resonator means of the plurality of resonator means is a second order filter oscillator which will generate a single sinusoidal waveform.

7. The synthesizer of claim 1 wherein said excitation signal for said human speech or acoustic signals are determined by the following equation:

$$S(n)=G(n)S'(n)$$

where

S(n) is the plurality of sinusoidal waveforms

G(n) is determined by the following equation:

$$G(n) = G^{-1} + \frac{n(G^0 - G^{-1})}{L}$$

where $$G^0 = \frac{\sqrt{\sum_{n=0}^{n=L} [S'(n)]^2}}{Energy},$$

$G^{-1}$ is the $G^0$ of the previous synthesizing frame sample, and

Energy is the energy description.

8. The synthesizer of claim 1 further comprising a linear predictive coding filter coupled between the plurality of resonator means and the gain shaping means to filter the plurality of sinusoidal waveforms as determined by a set of linear predictive parameters, wherein said data further comprises said linear predictive parameters.

9. A method for outputting speech by synthesizing excitation signals to artificially mimic human speech or acoustic signals from data, wherein said data comprises pitch frequencies of said human speech or acoustic signals for current and previous synthesizing frame samples, starting phase information for all harmonics of said human speech or acoustic signals within said current synthesizing frame sample, magnitudes for said harmonics, the voiced/unvoiced decisions for said harmonics, and an energy description of said synthesizing frame sample, comprising the steps of:

a) receiving said data;

b) interpolating pitch frequencies to create a plurality of pitch periods and pitch frequencies of said human speech or acoustic signals to prevent noise caused by sudden changes in data at synthesizing frame sample boundaries;

c) interpolating magnitudes of each of the harmonics of said human speech or acoustic signals to prevent noise caused by sudden changes in magnitudes of harmonics for each pitch frequency;

d) determining an end phase for each pitch frequency to allow smooth transition from a previous pitch frequency to a current pitch frequency;

e) synthesizing a plurality of sinusoidal waveforms for said human speech or acoustic signals having the pitch frequency, harmonics, time period, and magnitude;

f) merging and amplifying said plurality of sinusoidal waveforms according to said energy description to produce said excitation signals for said human speech or acoustic signals, and g) outputting the excitation signals to a transducer to reproduce said human speech or acoustic signals.

10. The method of claim 9 wherein the interpolating of pitch frequencies of said human speech or acoustic signals comprises the steps of:

a) initializing a first counter variable to zero;

b) initializing a frame variable to the period of the frame sample;

c) calculating an initial pitch frequency as $$P^0 = \frac{2\pi}{\omega^0}$$

where $\omega^0$ is the current pitch frequency for the current synthesizing frame sample;

d) calculating a previous pitch frequency as $$P^{-1} = \frac{2\pi}{\omega^{-1}}$$

where $\omega^{-1}$ is the previous pitch frequency for the previous synthesizing frame sample;

e) calculating a pitch frequency difference per frame length as $$\kappa = \frac{(P^0 - P^{-1})}{L}$$

where

L is a period of time of the synthesizing frame sample;

f) calculating an interpolated pitch frequency as $$\tau_p(i) = \frac{\tau_p(i-1)}{1-\kappa}$$

where:

i is the number of the pitch period interval, $\tau_p(i)$ is the pitch period interval of the current pitch period i, and $\tau_p(i-1)$ is the pitch period interval for the previous pitch period;

g) calculating and interpolated pitch frequency as $$\omega_j(i) = \frac{2j\pi}{\tau_p(i)}$$

where j is a counting variable representing each of the harmonics, and $\omega_j(i)$ is the frequency of each harmonic within the pitch period;

h) subtracting the interpolated pitch period from the frame variable;

i) if the frame variable is greater than zero incrementing the counter variable by a factor of one and returning to the calculating of the interpolated pitch period; and j) if the frame variable is not greater than zero, ending the interpolating.

11. The method of claim 9 wherein the interpolating the magnitudes of each of the harmonics of said human speech or acoustic signals comprises the steps of:

a) initializing a second counter variable to zero;

b) initializing a frame variable to the period of the frame sample;

c) calculating of the pitch frequency difference constant as $$C = \frac{2\pi(\omega^0 - \omega^{-1})}{L}$$

where $\omega^0$ is the current pitch frequency $\omega^{-1}$ is the previous pitch frequency and L is a period of time of the synthesizing frame sample;

d) initializing a previous interpolated pitch frequency to the current pitch frequency;

e) calculating a current interpolated pitch frequency as $$\omega(i) = \frac{\omega(i-1) \pm \sqrt{\omega(i-1)^2 - 4C}}{2};$$

where $\omega(i)$ is the current interpolated pitch frequency and $\omega(i-1)$ is the previous interpolated pitch frequency;

f) calculating a current interpolated pitch period as $$\tau_p(i) = \frac{2\pi}{\omega(i)}$$

where $\tau_p(i)$ is the current interpolated pitch period;

g) subtracting the interpolated pitch period from the frame variable;

h) if the frame variable is greater than zero incrementing the counter variable by a factor of one and returning to the calculating of the interpolated pitch period; and i) if the frame variable is not greater than zero, ending the interpolating.

12. The method of claim 11 wherein the interpolating magnitude of each of the harmonics of said human speech or acoustic signals comprises the steps of;

a) initializing a fourth counter variable to a number that is a count of the interpolated pitch frequencies;

calculating the interpolated magnitude of each of the harmonics as $$M_j(i) = M_j(i-1) + \frac{M_j^0 - M_j^{-1}}{2L}\tau_p(i)$$

$$M_j(0) = M_j^{-1}$$

$$\text{for } i = 1, 2, \ldots, I$$

where $M_j(i)$ is the magnitude of the harmonics within the current pitch period, $M_j(i-1)$ is the magnitude of the harmonics within the previous pitch period, and $$\kappa = \frac{C}{\omega^0 - \omega^{-1}}.$$

decrementing said fourth counter variable;

b) if the fourth counter variable is greater than zero returning to the calculating the interpolated magnitude; and c) if said fourth counter variable is not greater than zero, ending said interpolating of said magnitudes.

13. The method of claim 9 wherein the interpolating magnitude of each of the harmonics of said human speech or acoustic signals comprises the steps of;

a) initializing a third counter variable to a number that is a count of the interpolated pitch frequencies;

b) calculating the interpolated magnitude of each of the harmonics as $$M_j(i) = M_j(i-1) + \frac{M_j^0 - M_j^{-1}}{2L}\tau_p(i)$$

$$M_j(0) = M_j^{-1}$$

$$\text{for } i = 1, 2, \ldots, I$$

where $M_j(i)$ is the magnitude of the harmonics within the current pitch period, and $M_j(i-1)$ is the magnitude of the harmonics within the previous pitch period, c) decrementing said third counter variable;

d) if the counting variable is greater than zero returning to the calculating the interpolated magnitude; and e) if said counter variable is not greater than zero, ending said interpolating of said magnitudes.

14. The method of claim 13 wherein the determining of the end phase for each pitch frequency comprises the steps of:

a) initializing a fifth counter variable to a number that is a count of the interpolated pitch frequencies;

b) calculating said ending phase of each of the harmonics as $$\theta_j(i) = \sum_{k=0}^{k=i} \omega_j(k)\tau_p(k) + \Phi_j(0)$$

$$\theta_j(i) = \Phi_j(0)$$

$$\text{for } i = 1, 2, \ldots, I$$

where $\theta_j(i)$ is the ending phase, $\Phi_j(i)$ is and initial ending phase, and k is a counting variable for the number of all the pitch intervals, c) decrementing said fifth counter variable;

d) if the fifth counter variable is greater than zero returning to the calculating the interpolated magnitude; and e) if said fifth counter variable is not greater than zero, ending said interpolating of said magnitudes.

15. The method of claim 14 wherein the determining of the end phase for each pitch frequency comprises the steps of:

a) initializing a sixth counter variable to a number that is a count of the interpolated pitch frequencies;

b) calculating said ending phase of each of the harmonics as $$\theta_j(i) = \sum_{k=0}^{k=i} j\overline{\omega}_j(k)\tau_p(k) + \Phi_j(0)$$

where $\theta_j(i)$ is the ending phase, $\Phi_j(i)$ is and initial ending phase, and k is a counting variable for the number of all the pitch intervals, c) decrementing said sixth counter variable;

d) if the sixth counter variable is greater than zero returning to the calculating the interpolated magnitude; and e) if said sixth counter variable is not greater than zero, ending said interpolating of said magnitudes.

16. The method of claim 14 wherein the merging and amplifying is performed as $$S(n)=G(n)S'(n)$$

where

S(n) is the plurality of sinusoidal waveforms

G(n) is determined by the following equation:

$$G(n) = G^{-1} + \frac{n(G^0 - G^{-1})}{L} \text{ where}$$

$$G^0 = \frac{\sqrt{\sum_{n=0}^{n=L} [S'(n)]^2}}{\text{Energy}},$$

$G^{-1}$ is the $G^0$ of the previous synthesizing frame sample, and Energy is the energy description.

17. The method of claim 15 wherein the merging and amplifying of the plurality of sinusoidal waveforms for said human speech or acoustic signals is performed as $$S(n)=G(n)S'(n)$$

where

S(n) is the plurality of sinusoidal waveforms

G(n) is determined by the following equation:

$$G(n) = G^{-1} + \frac{n(G^0 - G^{-1})}{L} \text{ where}$$

$$G^0 = \frac{\sqrt{\sum_{n=0}^{n=L} [S'(n)]^2}}{\text{Energy}},$$

$G^{-1}$ is the $G^0$ of the previous synthesizing frame sample, and Energy is the energy description.

* * * * *